US005823886A

United States Patent [19]

Murray

[11] Patent Number: 5,823,886

[45] Date of Patent: Oct. 20, 1998

[54] NON RESTRICTIVE DORSIFLEXION FEEDBACK APPARATUS FOR GOLFERS

[75] Inventor: William B. Murray, Kemah, Tex.

[73] Assignee: Fred Collins and William B. Murray, a Texas Partnership, Houston, Tex.

[21] Appl. No.: 915,310

[22] Filed: Aug. 20, 1997

[51] Int. Cl.[6] ..... A63B 69/69

[52] U.S. Cl. ..... 473/213; 473/276

[58] Field of Search ..... 473/212, 213, 473/276

[56] References Cited

U.S. PATENT DOCUMENTS

| | | | |
|---|---|---|---|
| 2,064,603 | 12/1936 | Harrison . | |
| 3,400,934 | 9/1968 | Muehl | 473/213 |
| 4,660,829 | 4/1987 | Whiteneir . | |
| 5,324,038 | 6/1994 | Sasser . | |
| 5,509,809 | 4/1996 | Clay . | |

*Primary Examiner*—George J. Marlo
*Attorney, Agent, or Firm*—Vaden, Eickenroht & Thompson

[57] ABSTRACT

The current invention is a non-restrictive wrist break feedback apparatus for producing feedback concerning wrist joint position. The invention is useful in monitoring wrist motion for any sport but particularly useful for monitoring the "breaking" motion of the wrist during the play of golf. The device provides feedback in the form of an audible signal when the position of the hand in relation to the position of the forearm deviates from a desirable range, in respect to the forearm. The wrist break feedback apparatus of the current invention includes a frame with a first member, that generally aligns with the back of the hand, and a second member, that is pivotally connected to the first member. Feedback is produced when the first member deviates from the second member by more than a predetermined amount in a transverse direction relative to the forearm due to dorsiflexion.

10 Claims, 3 Drawing Sheets

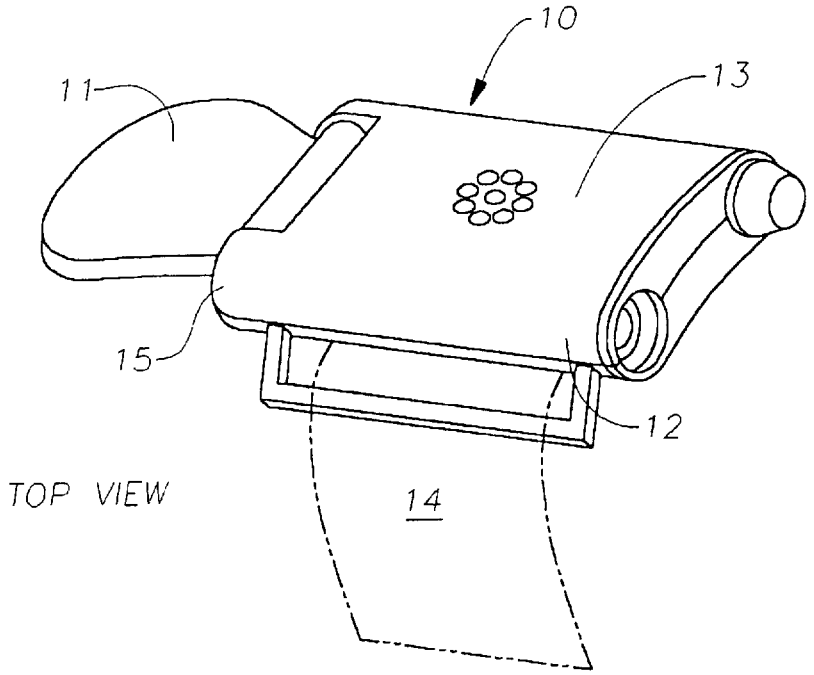
Fig. 1
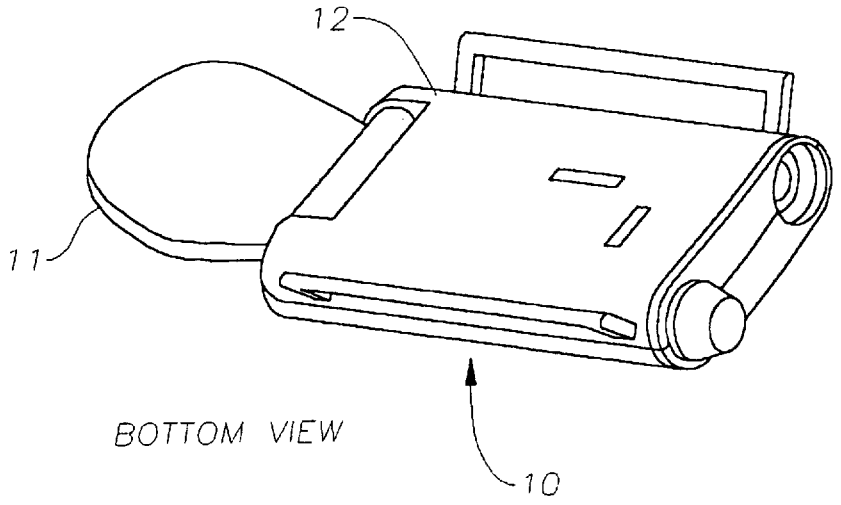

NON RESTRICTIVE DORSIFLEXION FEEDBACK APPARATUS FOR GOLFERS

BACKGROUND OF THE INVENTION

1. Field of the Invention

This invention relates to a wrist break feedback apparatus which provides non-restrictive feedback to golfers and others concerned about wrist position by indicating errant deviation in wrist position.

2. Description of the Prior Art

Positioning of the wrist on the lead, or forward, arm as well as positioning of the wrist of the power arm, or inside arm, are important factors in the development of an effective golf swing. While much attention is given to the cocking of the wrist, wrist break is equally important in developing the appropriate swing to square off with the ball.

Three wrist movements are generally studied for developing the appropriate golf swing. The first type of motion includes a "breaking" motion which includes dorsiflexion and palmarflexion. Dorsiflexion is the flexion observed when the palm of the hand is being held straight out palm down and the back of the hand is moved upwards.

Palmarflexion is when the hand is moved downwards from that same position. The second type of wrist motion includes "cocking" motion where the thumb moves towards the wrist producing radial deviation, or where the thumb moves away from the wrist producing ulnar deviation. The third type of wrist motion is rotational motion.

Numerous inventions address the cocking and rotational motion described above. Examples of such devices include the training device disclosed in U.S. Pat. No. 5,509,809 by Clay. The invention disclosed consists of a glove with a pocket attached to the back, wherein an electronic mechanism is fit. A predetermined position of the arm and wrist cause the mechanism to signal the golfer that the proper position has been achieved. This device is designed for use on the lead arm and is designed to provide immediate feedback for properly cocking the wrist without errant arm rotation by measuring the angle between the wrist and the thumb, or the "cocking".

U.S. Pat. No. 5,324,038 issued to Sasser provides a monitoring device with a wide, flat sensing member which extends along the back of the lead hand which is the left hand in a right handed golfer for monitoring pivotal motion. This flat member is provided with a tension spring and wheel which provides for continually biasing the sensing element into contact with the hand. A null position or reference position is set by establishing a circuit condition such that deviation away from this position causes an audio indicator of deviation. A complex circuit component is provided for establishing a circuit condition that is equatable to a null position for the leading hand. Another circuit component is provided to monitor the first circuit component condition.

U.S. Pat. No. 4,660,829 by Whiteneir provide a general body joint monitoring system for use between any pair of adjacent body portions interconnected by a body joint. This device is a multi-membered harness, one member being designated as a stationary reference member such that the relative position between the secondary members and the reference member can be monitored. A sensor device senses the position of the secondary members in relation to the reference portion and generates an electrical signal indicative of the relative position between the two portions. This electric signal is transmitted via cables which are attached to a headset for providing audio feedback.

U.S. Pat. No. 2,064,603 by Harrison discloses an audible signal device which is designed mainly for use in monitoring the cocking and uncocking of the wrist. This includes a signal-actuating lever member which moves up as it contacts the hand during cocking. Within the casing of the device is an audible signal member in the form of a thin plate of spring steel in which a circular depression has been pressed to locally distort or strain the member. Thus, movement of the lever member acts to flex the thin plate causing it to emit a snapping sound as an indicator to the person wearing the device.

It is an objective of the current invention to provide an effective non-restrictive training device to aid the golfer in developing the appropriate swing by monitoring "breaking" motion of the wrist.

It is a further objective of the current invention to train the golfer to develop a consistent wrist position throughout play through feedback when the wrist position deviates from the desirable range of positions.

It is still a further objective to provide a training device which is useful for developing proper wrist position, particularly in respect to breaking motion, of both the lead arm and the power arm.

It is still another objective to provide a device which can be applied for training in other sports or areas where position of the wrist is equally important.

These and other objects and advantages of this invention will be apparent to those skilled in the art from a reading of the application including the attached drawings and appended claims.

BRIEF SUMMARY OF THE INVENTION

The current invention is a wrist break feedback apparatus for producing feedback concerning wrist joint position. A preferred embodiment of the apparatus includes a frame having a first and second member with the first member being adapted to generally align with the back of the hand and the second member being generally adapted to align with the forearm. The first and second members are pivotally connected. A power source and a sensor are mounted to the frame. The sensor generates an electrical signal indicative of a deviation in the first member of the frame from the second member of the frame from a reference point in a transverse direction relative to the forearm. The sensor includes an electric circuit which is energized by the power source. A feedback means includes a feedback generator mounted to the frame for providing feedback concerning the deviation in the first member from the second member. The feedback generator is also energized by the power source. Additionally, a connector is provided for connecting the frame to a person.

In a preferred embodiment, a hinge pivotally connects the first and second member of the frame, permitting a setting to a predetermined angle beyond which, deviation is undesirable. Deviation beyond this predetermined angle, or maximum angle, causes the sensor to activate the feedback generator. The predetermined angle is defined by a first member position chosen by the golfer relative to a second member position. A preferred embodiment of the feedback generator includes a continuous audio output whenever the first member position deviates from the second member position beyond the settings of the predetermined angle. A preferred embodiment includes a wrist band of adjustable length adapted to be attached around a wrist portion of a person to hold the frame in contact with the person as the connector.

One preferred embodiment of the sensor includes two pieces of metal which come into contact with each other whenever the position of the first member deviates from the second member position beyond the setting. When the two metal pieces contact, the circuit is completed causing activation of the feedback generator.

Another preferred embodiment of the sensor includes the use of a microswitch that induces the electrical current when the microswitch is activated by the first member deviating from the second member beyond the setting. Yet another preferred embodiment includes a first member having a tongue member pivotally attached to a reference segment and a contact mounted on the reference segment such that depression of the tongue member towards the reference segment causes the tongue to touch the contact, thus completing a circuit which sends the electric signal that activates the feedback generator.

The wrist break feedback apparatus further includes a sensitivity operator for setting an allowable distance of deviation between the first and second member before activating the feedback generator. In this manner, the golfer chooses the setting of the predetermined angle.

BRIEF DESCRIPTION OF THE DRAWINGS

FIG. 1 shows the wrist break training device of a preferred embodiment, top and bottom, with the frame cover in place.

DETAILED DESCRIPTION OF THE INVENTION

Figure 2A:
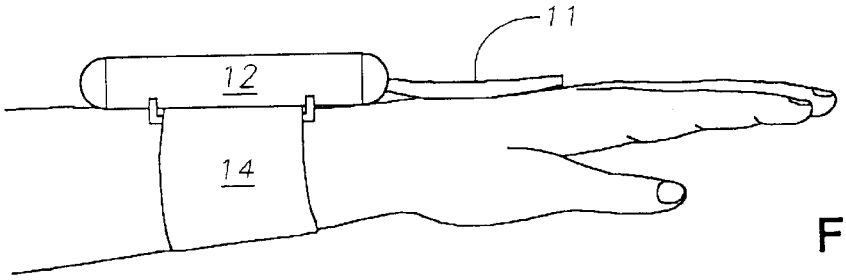
FIG. 2*a* shows the invention on a hand when the hand is at rest.
Figure 2B:
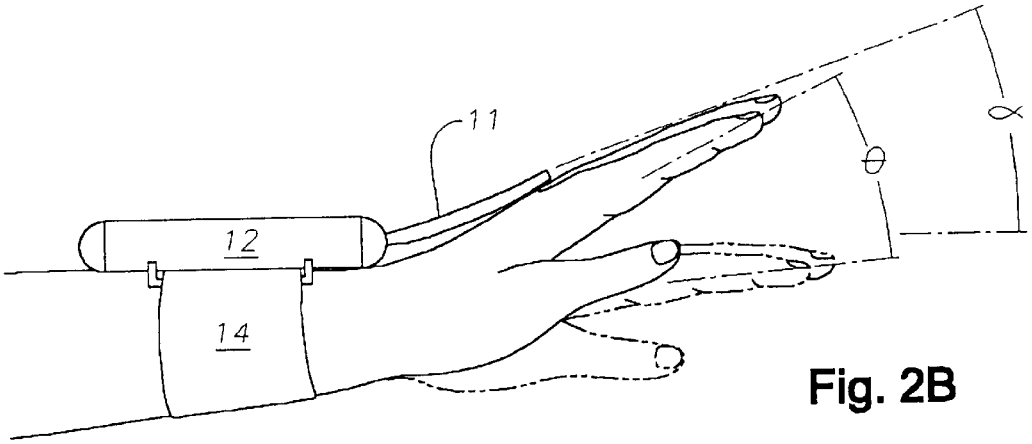
FIG. 2*b* shows dorsiflexion deviation being monitored by the wrist break training device when the hand deviates from the rest position.

FIG. 1 shows a preferred embodiment of the current invention. Frame 10 is attached to a golfer's wrist by wrapping connector or wrist band 14 around the wrist. In a preferred embodiment, wrist band 14 is a Velcro® strip which encircles the wrist. Frame 10, also called a case, includes a first member 11 and a second member 12. Second member 12 is held firmly in general alignment with the forearm by means of the wrist band, while first member 11 moves pivotally in relation to the second member when the golfer "breaks" the wrist. FIG. 1 shows the assembled device with cover 13 of second member 12 in place. When the hand is in a position at rest as shown in FIG. 2*a*, first member 11 is in an initial position which is, generally, in a straight line with second member 12. This initial position serves as a reference point of the position of the hand relative to the forearm. When dorsiflexion occurs, as demonstrated in FIG. 2*b*, the wrist deviates from the position at rest by Θ (theta) degrees. Likewise, first member 11 pivots by angle ∝ (alpha). Sensitivity operator 15, shown best in FIG. 1, allows the golfer to select the sensitivity of the device such that when angle ∝ (alpha) exceeds the preselected setting, feedback generator 17 (FIG. 3) is activated and produces an audio alarm. The sensitivity operator functions by moving a first contact point closer or farther from a second contact point, thus requiring less or more deviation of the first member before the alarm is produced. This alarm continues until the golfer changes the wrist position such that angle ∝ (alpha) is smaller than the preselected setting. As the hand is moved back towards the position of rest, a spring (not shown) moves the first member back towards the initial setting.

Sensitivity is set by adjusting sensitivity operator 15 to the desired position. This allows the device to be adjusted for varying degrees of sensitivity. Thus, the golfer can be alerted to slight deviations from proper play position, whereas the amateur golfer can allow for a wider degree of deviation before signalling such deviation.

Figure 3:
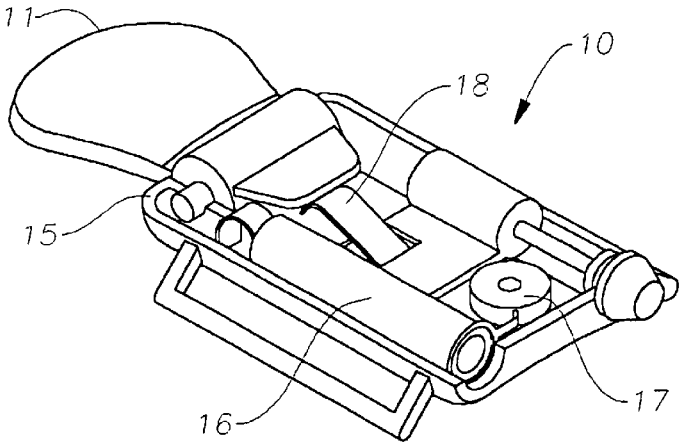
FIG. 3 shows a top view of a preferred embodiment of the invention when the frame cover is removed displaying power source and feedback generator.
Figure 4:
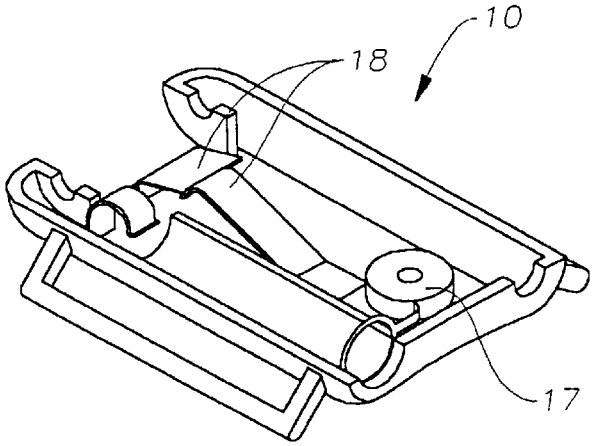
FIG. 4 shows the same view as FIG. 3 when the first member is removed to display contact strips.

Mounted to the frame, as shown in FIGS. 3 and 4, are power source 16 and feedback generator 17. The sensor mounted to the frame provides the electric circuit needed to connect the power source to the feedback generator when the angle ∝ (alpha) exceeds the predetermined setting. In a preferred embodiment, the power source is a 12 Volt battery and the feedback generator is a 12 Volt audio buzzer which will produce an alarm as long as an electrical circuit connecting the power source to the feedback generator is complete.

In a preferred embodiment as shown in FIG. 4, the sensor includes contact strips 18 which are pieces of metal. One set of strips demonstrated in FIG. 4 as being mounted to second member 12 acts as the second contact point. The other set of contact strips are not shown but are encased within first member 11 and act as the first contact point. These strips contact each other whenever the position of the first member deviates from the position of the second member such that angle ∝ (alpha) is exceeded. The pivoting motion around the hinge causes the strips to contact thus completing the circuit. This allows the power source to energize the feedback generator.

In another preferred embodiment, microswitches are used for closing small-capacity low-voltage circuits for generating the signal required to generate the audio signal. The microswitch (22) ties the battery and the feedback generator together.

Figure 5:
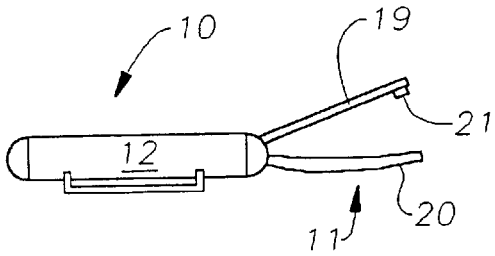
FIG. 5 shows another preferred embodiment where the first member includes a reference segment and a moveable tongue.
Figure 6:
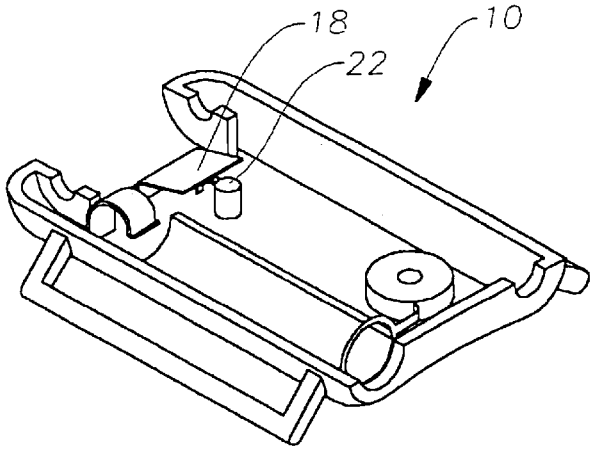
FIG. 6 shows the embodiment incorporating a microswitch such that the arm of the microswitch contacts the strip of the first member when such member is depressed.
Figure 7:
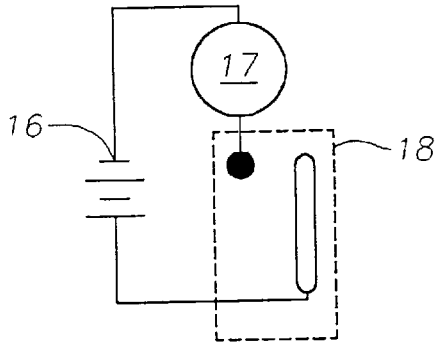
FIG. 7 shows a simple circuit utilized in the embodiments show n in FIGS. 4, 5 and 6, including a power source and feedback generator, which is completed when contact is made by the sensor strips or tongue.

In yet another preferred embodiment, shown in FIG. 5, first member 11 includes reference segment 19 and moveable tongue 20. The reference segment can be set to a maximum preselected setting and includes the second contact point. Motion of the wrist in the transverse direction causes the tongue, which acts as the first contact point, to move toward the reference segment until contact is made. A preferred embodiment allows for the reference segment to move pivotally once the tongue has been compressed to the reference segment. This allows the golfer unrestricted motion. Stationary contact block 21 is provided as part of the reference segment. The motion of the tongue into contact with the reference segment causes a first contact to meet the stationary block to close the circuit. The electric circuit is complete and the power source generates current sounding the feedback generator.

It will be understood that certain features and subcombinations are of utility and may be employed without reference to other features and subcombinations. This is contemplated by and is within the scope of the claims.

While several embodiments have been described and illustrated, it will be understood that the invention is not limited thereto since many modifications may be made and will become apparent to those skilled in the art.

For example, the audio signal may vary in amplitude according to first member position relative to the second member position thus audibly indicating the degree of deviation. Also, various methods of completing the circuit may be used in addition to those methods described above. Additionally, the feedback means can be a non-electric method of signalling deviation.

The invention can be used by all golfers, right handed or left handed. All examples are made based on the right handed player, for ease of communication. Further, the invention may be used by any person to obtain feedback regarding the flexion of one or both hands where such feedback is desirable. For example, without limitation, such feedback may be desirable to a tennis player or a baseball player. By further example, without limitation, said device may be used by a football player to ensure that the hands remain in a generally dorsiflexioned position when that is desirable.

What is claimed is:

1. Wrist break feedback apparatus for producing feedback concerning breaking in wrist joint position, comprising:

a frame having a first and second member, said first member being adapted to generally align with the back of the hand, said second member being adapted to generally align with the forearm, said first and second member being pivotally connected;

a non-restrictive feedback means producing feedback when deviation of the first member from the second member from a reference point in a transverse direction relative to the forearm occurs due to dorsiflexion; and a connector for connecting the frame to a person.

2. The wrist break feedback apparatus of claim 1 wherein the feedback means comprises a power source mounted to the frame;

a sensor mounted to the frame for generating an electrical signal indicative of the deviation in the first member from the second member from the reference point in a transverse direction relative to the forearm, said sensor having an electric circuit energized by the power source;

a feedback generator mounted to the frame for providing feedback concerning the deviation in the first member from the second member, said feedback generator being energized by the power source.

3. The wrist break feedback apparatus of claim 2 further comprising a hinge for pivotally connecting the first and second member, said hinge permitting a setting to a predetermined angle, said predetermined angle being measured as a position of the first member position relative to a position of the second member, deviation beyond the predetermined angle causing the sensor to activate the feedback generator.

4. The wrist break feedback apparatus of claim 3 where the sensor includes two pieces of metal, said pieces of metal contacting each other whenever the first member position deviates from the second member position beyond the setting, contacting of said pieces of metal completing a circuit such that the feedback generator is activated.

5. The wrist break feedback apparatus of claim 4 further including a sensitivity operator for setting an allowable distance of deviation between the first and second member before activating the feedback generator.

6. The wrist break feedback apparatus of claim 3 where the sensor includes a microswitch that induces the electrical current when the micro switch is activated by the first member deviating from the second member beyond the setting.

7. The wrist break feedback apparatus of claim 6 further including a sensitivity operator for setting an allowable distance of deviation between the first and second member before activating the feedback generator.

8. The wrist break feedback apparatus of claim 3 where the first member further comprises a reference segment, a tongue member pivotally attached to the reference segment, and a contact mounted on the reference segment such that depression of the tongue member toward the reference segment causes the tongue to touch the contact thus completing a circuit which sends the electric signal that activates the feedback generator.

9. The wrist break feedback apparatus of claim 3 where the feedback generator produces an audio output whenever the first member position deviates from the second member position beyond the setting.

10. The wrist break feedback apparatus of claim 9 where the connector is a wrist band of adjustable length adapted to be attached around a wrist portion of a person to hold the frame in contact with the person.

* * * * *